US006499655B1

(12) United States Patent
Moen

(10) Patent No.: US 6,499,655 B1
(45) Date of Patent: Dec. 31, 2002

(54) COMPARTMENTED CONTAINER

(76) Inventor: Lenard E. Moen, 7914 Michigan, Whittier, CA (US) 90602

( * ) Notice: Subject to any disclaimer, the term of this patent is extended or adjusted under 35 U.S.C. 154(b) by 0 days.

(21) Appl. No.: 09/524,415

(22) Filed: Mar. 11, 2000

(51) Int. Cl.[7] ..... B65D 25/04

(52) U.S. Cl. ..... 229/120.24; 229/120.26; 229/120.29; 229/164

(58) Field of Search ..... 229/120.24, 120.26, 229/120.29, 120.37, 122.21, 122.24, 122.26, 122.32, 164

(56) References Cited

U.S. PATENT DOCUMENTS

| | | | | | |
|---|---|---|---|---|---|
| 2,308,177 | A | | 1/1943 | Jones | |
| 3,348,667 | A | * | 10/1967 | Beeby | 229/120.37 |
| 3,921,893 | A | * | 11/1975 | Randle, Jr. | 229/122.21 |
| 3,985,286 | A | * | 10/1976 | Hicks | 229/120.26 |
| 4,120,443 | A | * | 10/1978 | Gardner et al. | 229/120.24 |
| 4,164,312 | A | | 8/1979 | Harned | |
| 4,282,999 | A | | 8/1981 | Moen | |
| 4,376,507 | A | * | 3/1983 | Nauheimer | 229/120.24 |
| 4,601,687 | A | * | 7/1986 | Gallaher | 493/89 |
| 4,793,494 | A | * | 12/1988 | Gordon, Jr. | 229/122.24 |
| 4,826,016 | A | | 5/1989 | Foster | |
| 4,955,502 | A | * | 9/1990 | Sorci | 220/528 |
| 5,316,210 | A | * | 5/1994 | Scullin | 229/120.26 |
| 5,520,325 | A | * | 5/1996 | Quaintance | 229/120.26 |
| 5,950,915 | A | * | 9/1999 | Moen | 229/122.24 |
| 5,975,413 | A | * | 11/1999 | Moen | 229/122.24 |
| 6,311,891 | B1 | * | 11/2001 | Gardner | 229/120.24 |

* cited by examiner

*Primary Examiner*—Gary E. Elkins
(74) *Attorney, Agent, or Firm*—Frederick E. Mueller

(57) ABSTRACT

An E Bliss compartmented container comprising an erected E divider blank about which a Bliss body blank has been erected with its endwalls adhesively laminated to endwall panels of the E divider. The E blank comprises a rectangular piece of corrugated fiberboard material having a pair of divider panels, a pair of sidewall panels, a pair of endwall panels and, if desired, a pair of corner post flanges, all symmetrically arrayed about a longitudinal center line. The divider panels comprise the end-most pair of all of the panels of the blank which is completely severed through from end to end along the longitudinal center line, except for a spaced apart pair of intact crush score areas interconnecting the pair of divider panels as a hinge. The body blank comprises a substantially rectangular piece of material having a central bottom panel with integral opposite endwall panels and a pair of sidewall flaps.

9 Claims, 6 Drawing Sheets

105

70
70
72
74
74
76

62
76
74
72
74
72
E
70
70

70
64
70
72
74
72
74

74
72
72
74
M

124

96
94
120
96
98
98
100
92
90
100
124
B

D

105'

70'
70'
74'
72'
72'
74'
72'
70'
E'
73
74'
70'
73
75

64'
72'

74'
74'
74'
74'

M'
73

96'
94'

98'
120'
96'
98'
S
100'
92'
94'
100'
B'

COMPARTMENTED CONTAINER

BACKGROUND OF THE INVENTION

The present invention relates to the manufacture of paperboard containers and, more particularly, compartmented shipping and display containers. It is known in the prior art to make a display or shipping container by first making a regular slotted container (RSC) or a half slotted container (HSC), loading the container with the product (e.g., bottles), and thereafter inserting into the thus preformed tray container a generally E shaped divider strip. The blank of which the E divider is formed is of a width the same as the height of the RSC or HSC container and has an overall length equal to the sum of the container walls to be doubled and the two panels comprising the divider partition. The E blank thus comprises a long spindly piece which creates shipping problems for the corrugator and handling problems for the box maker. The E blank is typically first folded into the E configuration and then manually or machine inserted into the preformed RSC or HSC container.

SUMMARY OF THE INVENTION

An E blank and a companion body blank are assembled to make a compartmented container for either a display container or a shipping container. The E blank comprises a rectangular piece of corrugated fiberboard material having, symmetrically arrayed about a longitudinal center line, a pair of divider panels, a pair of sidewall panels, a pair of endwall panels and, if desired, a pair of corner post flanges. The divider panels comprise an end-most pair of all the panels of the blank. The E blank is completely severed through from end to end along the longitudinal center line, except for a spaced apart pair of intact crush score areas inter-connecting the pair of divider panels as a hinge.

The body blank comprises a substantially rectangular piece of corrugated material having a central bottom panel with integral opposite end wall panels. In the case of a display container, the bottom wall panel has a pair of opposite side wall flaps, one of which comprises a marginal window flap. In this case, the end wall panels are each flanked by marginal corner flaps on opposite sides, one of which is is formed with a joggled portion to cover a notch of a corner post flange of the companion end wall of the E divider, the flange being thus configured to provide a recess for one end of the window flap. In the case of a shipping container, the opposite side marginal flaps of the bottom panel are similar, as are the marginal corner post flaps of the end wall panels.

In the assembly of a display container of the invention, the flat E blank is advanced in a horizontal plane to a first station wherein the divider panels are restrained horizontally while the side wall panels, end wall panels and corner post flaps or flanges are turned downward 90 degrees. The blank is next advanced to a position over a split mandrel into which the divider panels are next folded together. Folding of the divider panels effects rotation of the side wall panels, end wall panels and marginal flaps into a horizontal position while those flaps are being restrained within a common vertical plane. Thereafter, the end wall panels and corner post flaps are progressively folded about the mandrel.

In the case of a shipper box, the pair of divider panels carry another pair of side wall panels while the manner of the formation of the box is substantially similar to that of the display container.

During the folding assembly process, adhesive is applied to produce a laminated pair of divider panels as a result of their folding. Adhesive is also applied to all areas of the body blank except the floor panels such that the resulting structure comprises adhesively laminated together vertical members on all four sides.

DESCRIPTION OF THE PRIOR ART

Figure 11:
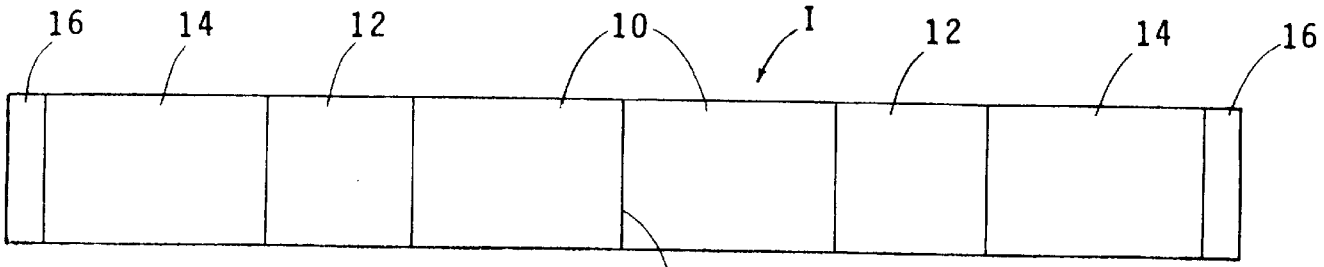
FIG. 11 is a plan view of an E style insert die cut blank of the prior art.

Referring to FIG. 11, there is shown an E style insert blank I comprising an elongate rectangular piece of corrugated fiberboard comprising a corrugated media faced on opposite sides with paper liners. The blank I is formed with a plurality of edge to edge transverse score lines to define relatively foldable panels. In the illustrated case, the scores define a blank having the length of six panels and a pair of opposite end flanges, namely, a pair of divider panels 10 flanked by a pair of sidewall panels 12, that are further flanked by a pair of endwall panels 14. Opposite ends of blank I include a pair of corner post flanges 16.

Figure 12:
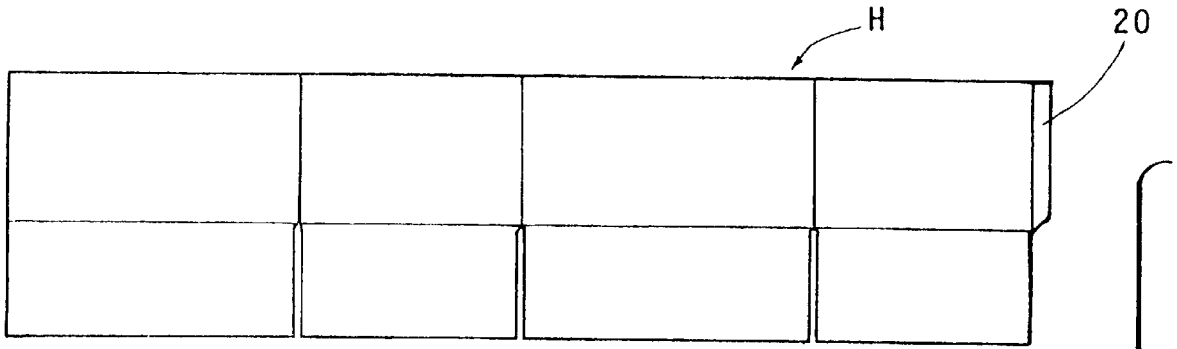
FIG. 12 is a plan view of a body blank for an HSC container of the prior art.
Figure 13:
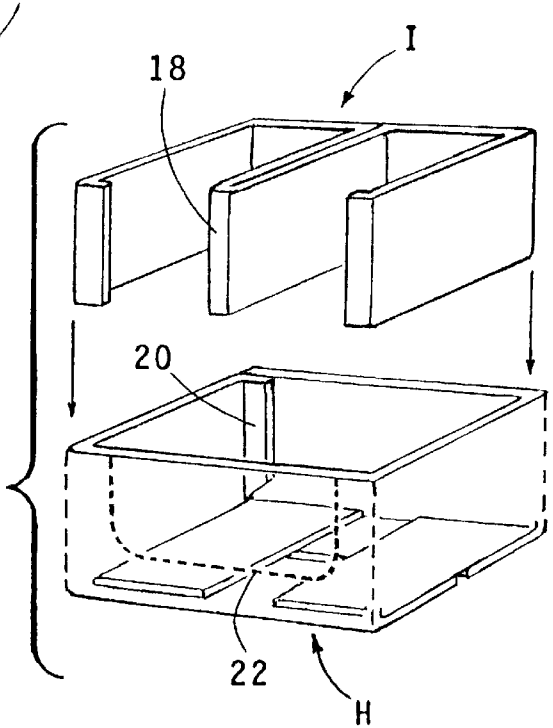
FIG. 13 PRIOR ART
FIG. 13 is a schematic perspective view of an erected E style insert positioned above an erected HSC container of the prior art shown partly in phantom line.

The central one of the transverse scores of the blank I constitutes a hinge line 18 about which the divider panels 10 are folded into mutual abutment in erecting the blank I into the erected configuration shown in FIG. 13. Thus, as is well understood in the art, after the divider panels 10 have been folded, the pairs of sidewall and endwall panels and the end flaps 16 can be successively folded into the generally E shaped An HSC body blank H is shown in FIG. 12. As is well understood, it comprises a substantially rectangular piece of corrugated material having four wall panels, each of which has a marginal floor panel, as well as a flap 20 at one end comprising what is referred to as the manufacturer's joint. When erected and glued at the manufacturer's joint, the blank assumes the open top box shape shown in FIG. 13, the floor being defined by the folded and sometimes glued marginal floor flaps of the blank.

In a display version of the prior art box one of the wall panels of the body H is provided with a tear-out portion 22 which can be removed to display the product contained within the box. The E insert is so oriented within the box that when the tear out panel has been removed, its folded hinge 18 is oriented vertically and about centrally within the box opening.

It should be understood that in the use of the E style insert of the prior art in conjunction with HSC and RSC boxes, the product to be shipped and/or displayed is loaded into the box prior to insertion of the E divider. The folded together divider panels 10 thus deflect laterally upon impinging product loaded in the box during insertion of the insert into the box. It is also impractical to apply adhesive on the inner surface of the HSC box or the outer surfaces of folded E insert and then join them together since in the process of insertion the glue would be smeared and the desired adhesion would be rendered ineffective.

DESCRIPTION OF THE PREFERRED EMBODIMENTS

Figure 1:
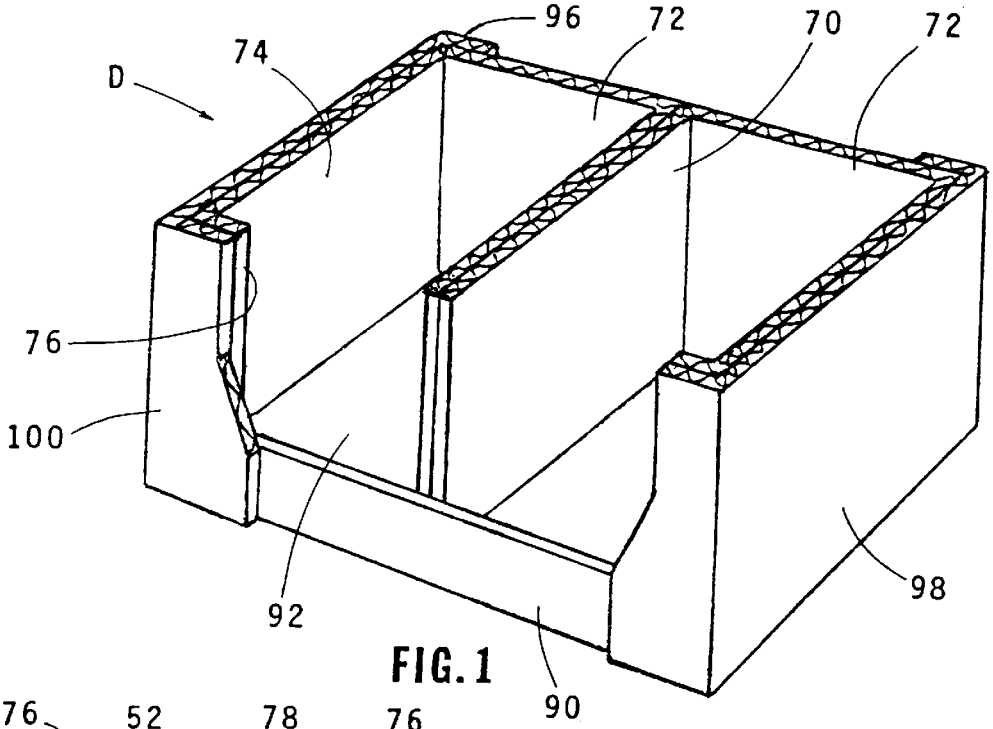
FIG. 1 is a front perspective view of an E Bliss display container of the invention.
Figure 2:
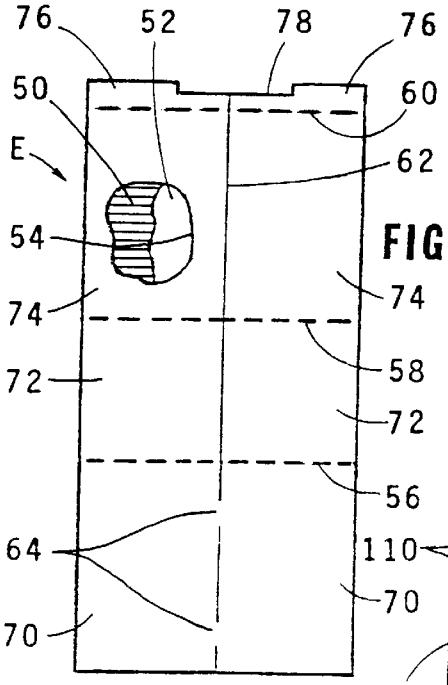
FIG. 2 is a plan view of an E blank for the container of FIG. 1.

FIG. 1 illustrates a display box embodiment of the invention designated generally by the letter D. The box D comprises an assembly of two blanks, namely a blank E as shown in FIG. 2 and a body blank B shown in FIG. 3. Each of the blanks E and B is made of a corrugated fiberboard or cardboard material.

More particularly, the blank E comprises a generally rectangular piece of material having a corrugated media 50 sandwiched between an opposite pair of paper liners 52 and 54. The panel is formed with edge to edge transverse scores 56, 58 and 60. The blank E is formed with a cut 62 from end to end along its longitudinal center line through both liners and the corrugated media 50 except for a spaced pair of crush scores 64 at the junction of the pair of divider panels 70 as a hinge.

These various scores divide the blank E into a pair of divider panels 70, a pair of sidewall panels 72, a pair of end wall panels 74 and corner post flanges 76. Each of the corner post flanges 76 is formed with a notch 78 providing a clearance space for reception of a portion of the body blank, as will presently appear.

The body blank B comprises a substantially rectangular piece of material likewise comprising a corrugated media 82 sandwiched between an opposite pair of liners 84 and 86. The blank B is formed with a transverse pair of crush scores 88 defining opposite ends of a bottom panel 92 of the body blank. One side of bottom panel 92 is formed with a marginal side wall flap 94 and on the other side with a marginal window flap 90. Both ends of the bottom panel 92 are flanked by integral foldable end wall panels 98 that are mirror images of one another. Each end wall panel is flanked at one side by a foldable marginal flap 96 and on the other side by a foldable marginal corner post flap 100, the latter flaps being configured with a joggle notch 102. The marginal side flaps 94, 90 of the bottom panel are of an abbreviated length to define notches 104 between opposite ends of the flap 94 and the companion ends of the corner post flaps 96 on one side of the bottom panel and notches 106 between opposite ends of the window flange 90 and companion ends of the corner post flanges 100 on the other side. A parallel pair of perf stitch scores 110 are formed along opposite sides of the blank B in defining the opposite sides of bottom panel 92 and endwall panels 98 and to permit folding of their respective marginal flaps and flanges.

Referring to FIG. 4, it will be observed that the blank E is first erected into a generally E shaped configuration, brought into registration with the footprint defined by the bottom panel of the body blank B and the body blank thereafter erected therearound.

Figures 4A, 4B, 4C, 4D, 4E, 4F, 4G, 4H:
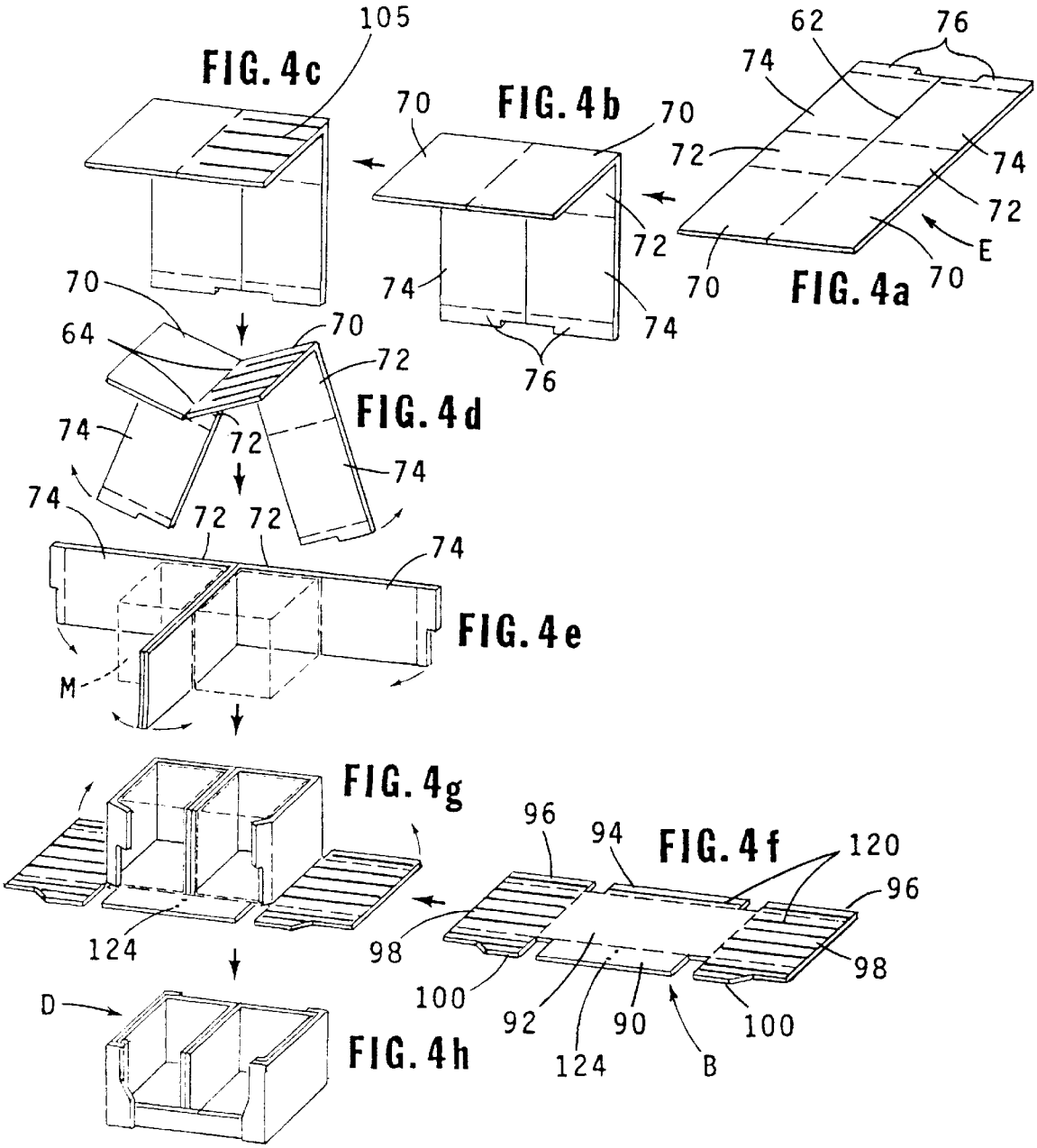
FIGS. 4*a* through 4*h* comprise a schematic flow diagram illustrating steps involved in the formation of the container of FIG. 1 with the blanks of FIGS. 2 and 3.

To initiate the process of making the box D, a blank E is disposed in a flat horizontal plane as in FIG. 4*a*. Thereafter, it is advanced in the direction indicated by the arrow to the next station shown in FIG. 4*b*. More particularly, while the divider panels 70 of the E blank are restrained into the horizontal plane, the sidewall panel 72, and wall panels 74 and corner post flaps 76 are turned downward 90 degrees. A guide plate confines the trailing downwardly projecting panels to maintain them in the downwardly extended direction as the E blank is advanced into an indexed position above a split mandrel M, as in FIG. 4*c*. The mandrel may have a structure and mode of operation like that disclosed in my U.S. Pat. No. 4,310,323, which is incorporated hereby by this reference. During this phase of movement beads or strips of hot melted glue or the like, indicated by the lines 105, are applied to one or the other of the divider panels, preferably the trailing divider panel.

Next, referring to FIGS. 4*d*, 4*e*, the divider panels 70 are rotated together into mutual abutment, or nearly so, while being advanced downwardly to a position within the gap of slotted mandrel M, indicated in phantom outline. Simultaneously, as a function of rotation of the divider panels 70 towards one another and while being restrained within a common vertical plane, the companion pairs of sidewall panels 72, endwall panels 74 and corner post flaps 76 are rotated from the vertically depending to the horizontally extending positions shown. As the pair of divider panels approach final mutual abutment, the gap of the mandrel M is closed to apply dispersing pressure on the strips of glue 105.

The partially folded E blank now being indexed with respect to the mandrel M, the pair of endwall panels 74 are rotated into contact with opposite end faces of the mandrel and the corner post flaps or flanges 76 thereafter rotated at least partially around corresponding corners of the mandrel. (FIG. 4*g*.)

The formed E blank now being held in an indexed position within the mandrel, the flat body blank B is advanced from the position of FIG. 4*f* to bring its bottom panel 92 into registration as a footprint of the fully erected E blank. During the course of transition to the indexed position of FIG. 4*g* beads of glue 120 are deposited on marginal flaps 94, 96, 98 and 100. Instead of lines of glue, the window flap 90 of the bottom panel 92 has a spaced pair of dots of glue 124 deposited thereon at about its midpoint for ultimate adhesion to vertical edges of an end of the glue-laminated divider panels 70 of the formed E divider.

After the blank B has been moved into the fully indexed position and into contact with lower edges of the erected E blank, the marginal flaps 94 and 90 of the bottom panel are first raised into adhesive contact with, respectively, the outside surface of lower marginal portions of the sidewall panel 72 of the E blank and edges of the pair of divider panels 70 confronting the midpoint of the wind flange 90. opposite ends of the window flange 90 are now positioned to register with their companion notches 78 of the corner post flanges 76. Thereafter, the pair of opposite end wall panels 98 of the body blank are erected into adhesive contact with the outside surfaces of the endwall panels 74 of the erected E blank. Finally, the corner post flanges 96 and 100 of the body blank are turned into adhesively engaged contact with outer surfaces of the companion ones of the sidewall 72 and corner post flanges 76 of the E blank, the flanges 100 acting to complete folding of the flaps 76 through 90 degrees. folding of the flaps 76 through 90 degrees.

Figure 3:
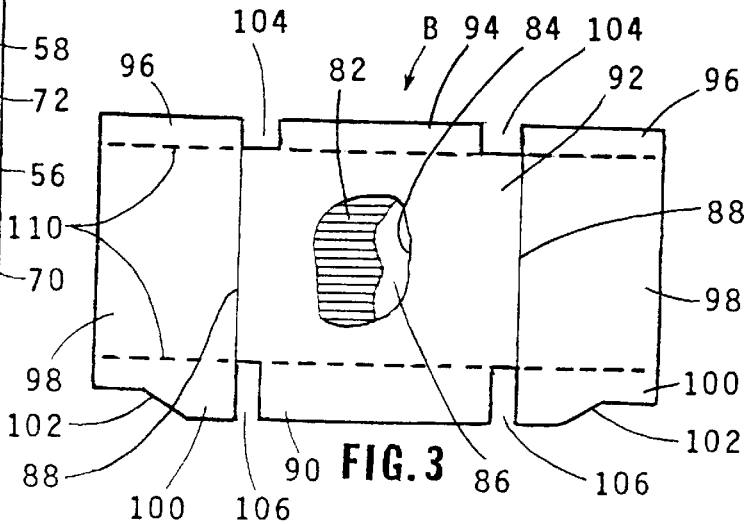
FIG. 3 is a plan view of a Bliss body wrap blank for the container of FIG. 1.
Figure 5:
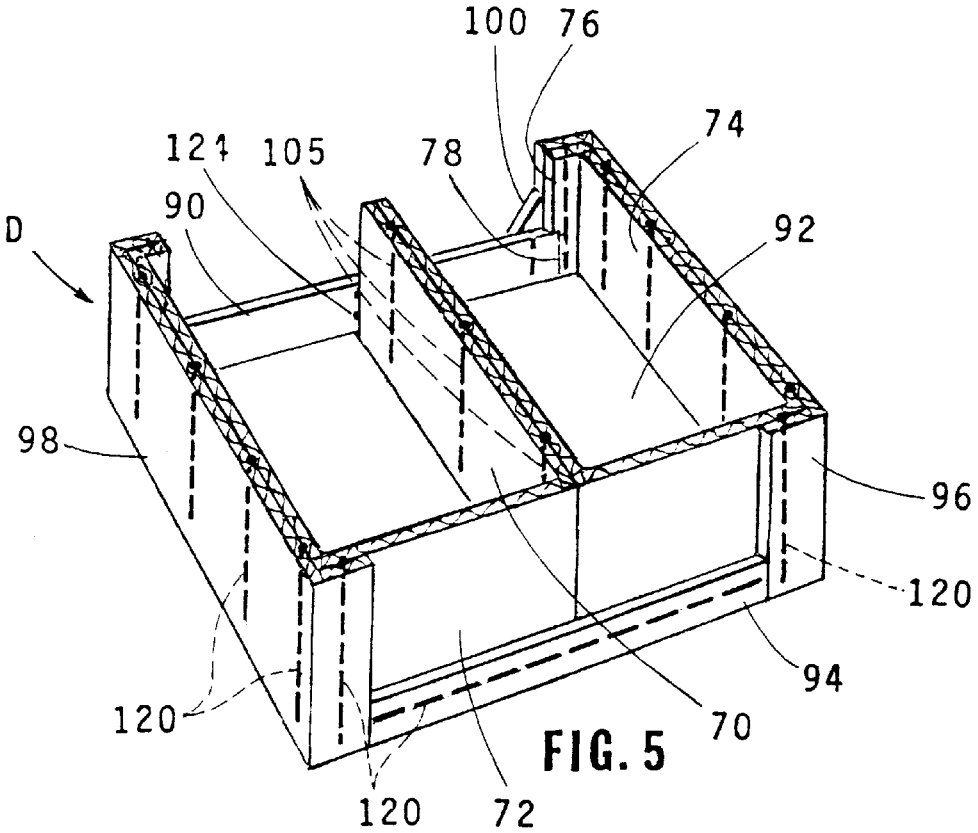
FIG. 5 is a rear perspective view of the display container of FIG. 1 but with a phantom indication of glue lines.

The preferred orientation of the flutes of the corrugations 50 of the blank E and flutes of the media 82 of the blank B is shown in FIGS. 2 and 3. Thus, when the two parts are combined in the manner just described, all of the corrugated media of the E divider is oriented vertically as is the corrugated media of the endwalls 98 of the body wrap and its corner posts 96 and 100. Moreover, as shown in phantom line in FIG. 5, all of the vertical elements of the resulting box structure are adhesively laminated together resulting in superior stacking strength for the completed display box D.

Figure 6:
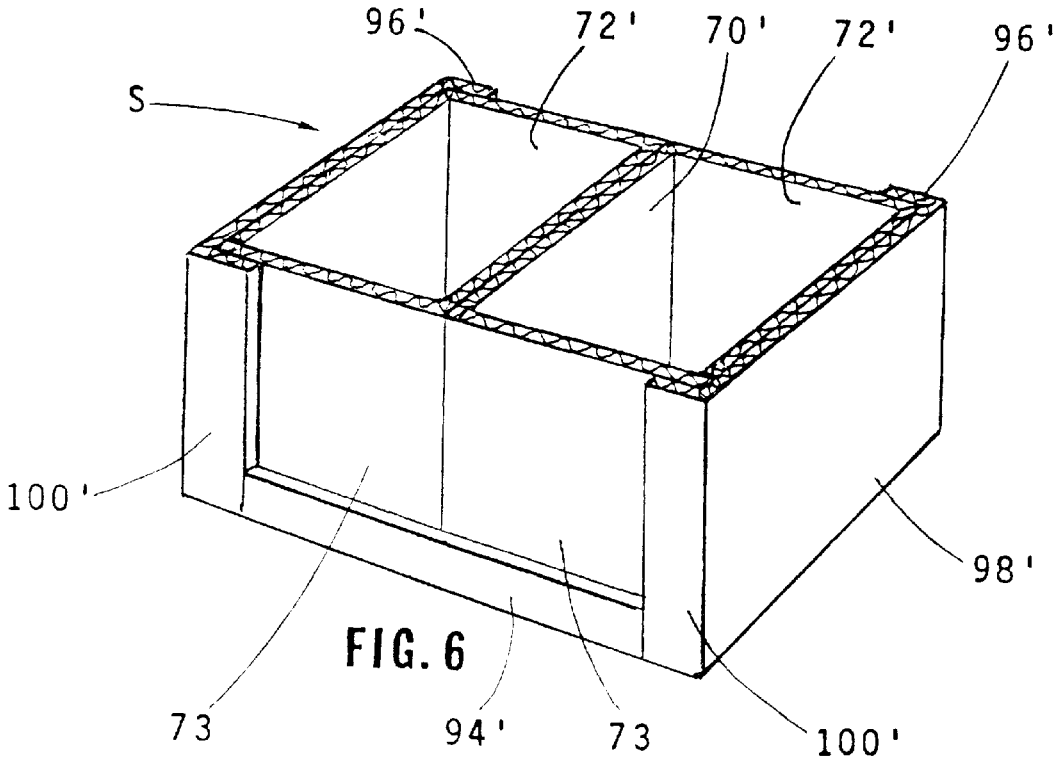
FIG. 6 is a front perspective view of a shipper box of the invention.
Figure 7:
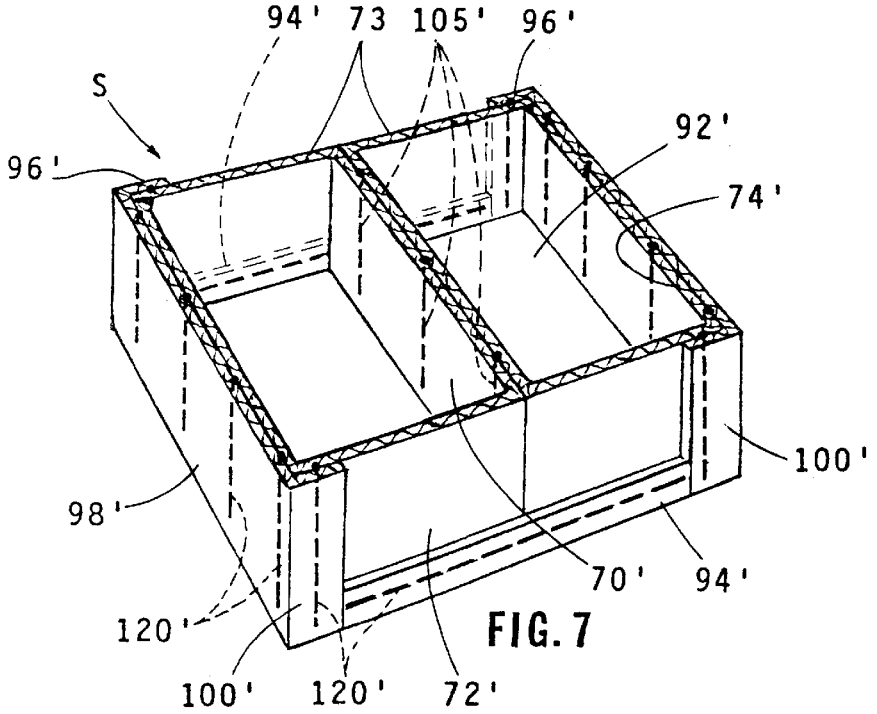
FIG. 7 is a rear perspective view of the shipper box of FIG. 6, with a phantom line indication of glue lines.
Figure 8:
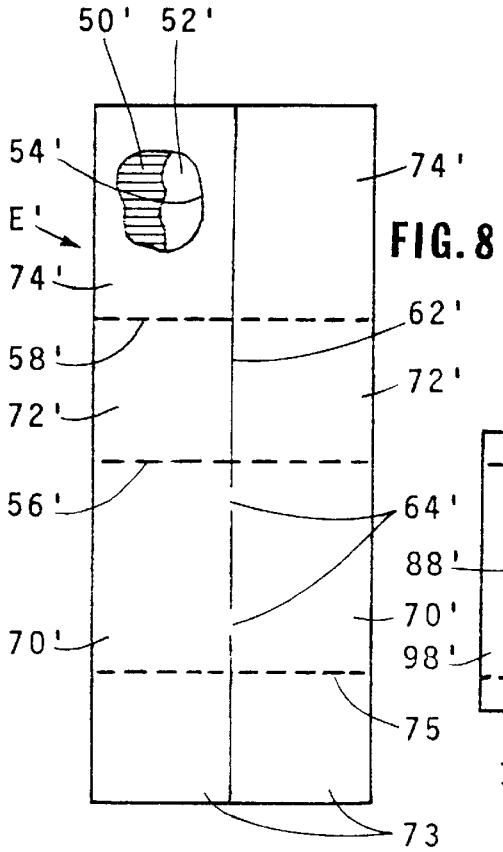
FIG. 8 is a plan view of an E blank for the shipping container of the invention.
Figure 9:
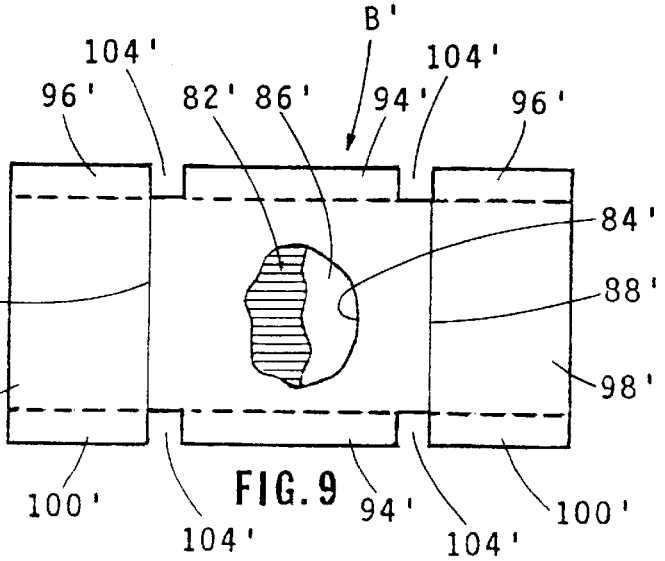
FIG. 9 is a plan view of a Bliss body wrap blank for the shipping container of the invention.

As an alternative embodiment of the invention, FIGS. 6 and 7 show a completed shipper box S. The box S is made of an E divider blank E' as shown in FIG. 8 and a body blank B' as shown in FIG. 9. The blank E' is the same in all respects as the previously described blank E, except that another pair of sidewall panels 73 are provided disposed symmetrically with respect to the sidewall panels 72'. Corresponding parts are identified by the same numerals with the addition of a prime. The additional side wall panels 73 are foldably joined to the divider panels 70' by a transverse edge to edge score 75 while their adjoining edge are separated by a cut 62' along the longitudinal center line from one end to the other of the blank, leaving intact the hinge scores 64' of the divider panels. The body blank B' for the shipper box is in all respects like the blank B for the display box except that in lieu of the window flange 90, the bottom panel 92 is flanked on its opposite sides by a symmetrical pair of sidewall flanges 94' and corner flanges 100' are shaped without joggle notches 102.

Figures 10A, 10B, 10C, 10D, 10E, 10F, 10G, 10H:
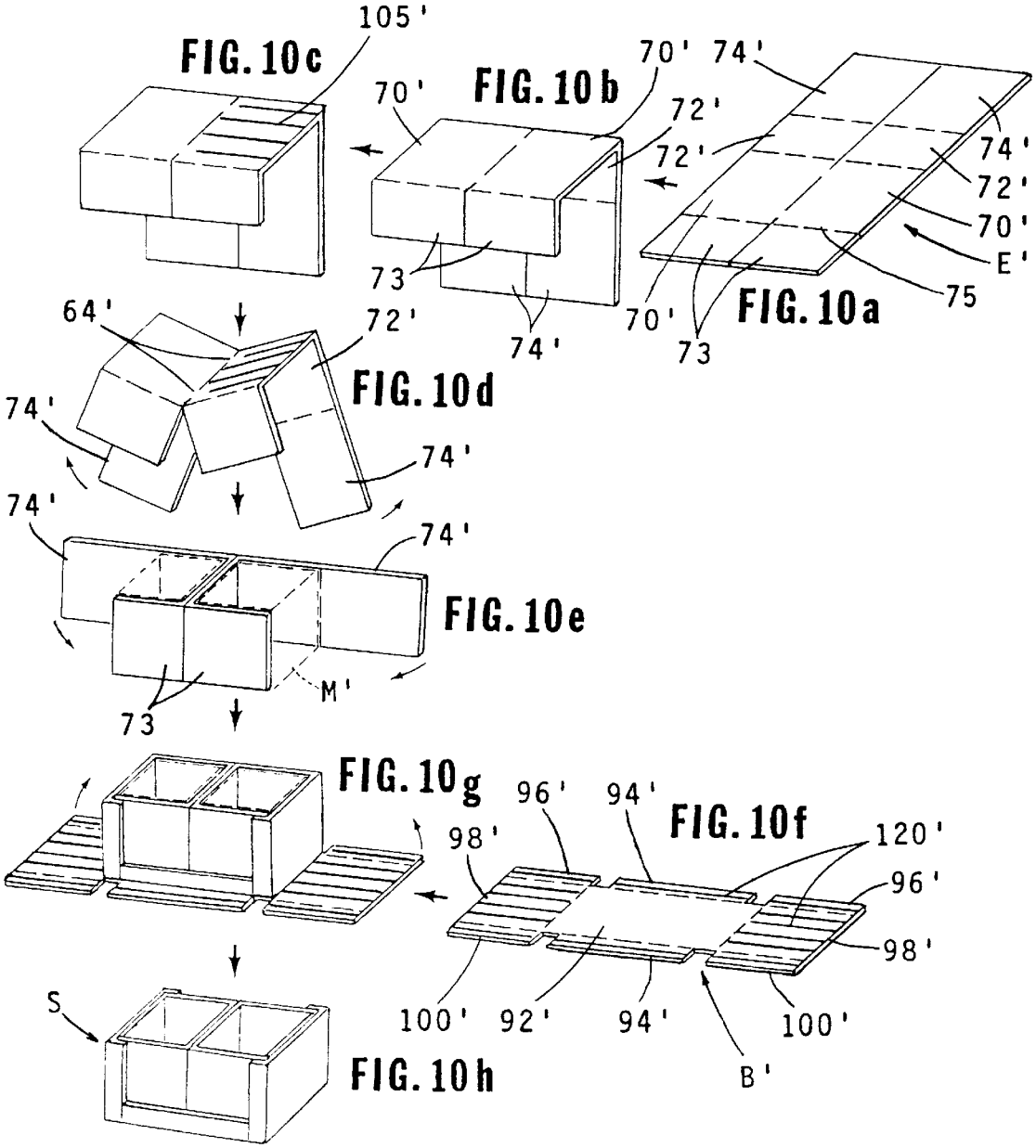
FIGS. 10*a* through 10*h* illustrate various steps involved in the formation of the container of FIGS. 6 and 7 with the blanks of FIGS. 8 and 9.

The method of making the shipper box D is very much like that described with regard to the display box D. However, the additional sidewall panels 73 are turned downwardly 90 degrees in the second station, as illustrated in figure 10*b*, substantially concurrently with downward folding of the other sidewall panels 72', end wall panels 74' and corner post flanges 60'. In succeeding steps the panels 73 are manipulated symmetrically to sidewall panels 72'.

As should now be apparent, the invention has substantial advantages over the prior art:

The box of the invention can be fabricated with substantially less material than in the case of the prior art.

Because of its great length (e.g., six panels, plus corner flanges, if desired) the insert of the prior art requires special pallet sizes for bundling and it is relatively awkward to handle despite its symmetry about mid score 18. The blanks of the invention are about half as long (e.g., three panels, plus corner flanges, if desired) and so fit easily with a standard pallet or bundle size and are more convenient to handle despite having an unequal number of panels at opposite ends of the divider panels (FIGS. 2, 8).

In processing by a corrugator, the HSC or RSC blank requires one operation to die cut and a second operation to fold and glue the manufacturer's joint. The manufacturer's joint makes an uneven thickness in a narrow portion of the folded components. When palletizing, the bulge created by this extra thickness causes an unstable load and parts at the lower level in the load opposing the joint are subject to pre-crush, which weakens the material. By contrast, with the invention no other processing is required from the corrugator other than die cutting. As the E blanks of invention are flat die cut material of only one thickness there are no problems with pallet load stability or danger of precrush.

There are also substantial advantages for the box assembler by use of the invention:

Use of the invention results in a box of superior strength: Because of the impracticality of gluing the E insert of the prior art into an HSC or RSC box, the formed insert is placed in the box as a loose component. The purpose of the insert is to increase the load bearing capacity of the box perhaps by twice.

By contrast, with the invention adhesively laminating the E divider within and to the body wrap almost doubles the load bearing capacity of the box. Because of this phenomena, it is practical to reduce the weight of the liner board materials to achieve economies without detracting from the strength of the box.

Typically, an HSC box has major and minor flaps on the bottom of the box. The major flaps extend to the center and close the bottom of the box. The minor flaps overlap the majors and create an uneven surface for product to rest on (FIG. 13). If there happens to be a poor glued joint, the flaps may break open and cause the contents to drop when the box is picked up. Joints in the bottom area are wasteful because they do not contribute other strength values to the box.

By contrast, the box of this invention has a solid bottom that is an integral part of the vertical components of the box. The bottom surface is one thickness and presents a smooth level surface for the product to rest on. The glued joints of the box are located in the vertical structure where the added thickness contributes to additional stacking strength.

In the prior art, flaps can be added to the top of the RSC box to effectively close the top of the box. The economies are poor for the same reasons given relative to the box bottom design of overlapping flaps.

By contrast, the body wrap of the invention can be extended to provide a top closure and fitted with narrow flap extensions that seal against the box sidewall of a totally closed box, or at the back, front corners and overlapping center of an open faced display box. The E Bliss container provides a more balanced load bearing structure with laminated divider ends and corners of the box. It does not require additional or stronger material to compensate for an unbalanced structure like the prior art, which is stronger in the back than in the front of the box.

The nature of corrugated fiberboard is such that blanks used in making boxes are prone to warpage. Once a box is formed out of the insert blank and body blank some of the warpage may be removed but there will still be a warp in the box side walls. However, with this invention, when the warped materials are laminated together the stress factor induced by the warpage is almost completely neutralized.

While the invention has been disclosed and described in connection with its preferred embodiments, it will be appreciated by those skilled in the art that the invention is not limited to the disclosed embodiments but is susceptible of being carried into effect in other embodiments.

I claim:

1. A paperboard blank to be erected into a substantially E shaped configuration, said blank having a rectangular planform and a plurality of transverse edge to edge score lines dividing the blank into a pair of adjacent hingedly interconnected divider panels at one end of said blank, the hinge axis being on a longitudinal center line of said sheet, a first pair of panels each of which is foldably joined to a first end of one of said divider panels at a first one of the score lines, and a second pair of panels each of which is foldably joined to one of said first pair of panels along a second one of said score lines, both the first pair of panels and the second pair of panels being severed from one another along the longitudinal center line of the blank.

2. A paperboard blank as in claim 1 wherein the hinge axis joining the pair of divider panels comprises a spaced apart pair of crush scores constituting the sole interconnection between the divider panels.

3. A paperboard blank as in claim 1 in which a flange is foldably joined to a distal end of each of said second panels along a third transverse score line of the blank, the pair of flanges being severed from one another along the longitudinal center line of the blank.

4. A paperboard blank as in claim 1 comprising a corrugated media faced on opposite sides by top and bottom paper liners, the flutes of the media being oriented transversely to the longitudinal axis of the blank.

5. A companion pair of an E divider blank and a body blank, the E blank comprising a rectangular piece of corrugated fiberboard material having a pair of divider panels, a pair of sidewall panels, and a pair of endwall panels, the divider panels comprising an endmost pair of all of the panels of the blank, the E blank being completely severed from end to end along its longitudinal center line except for a spaced apart pair of intact crush score hinges interconnecting the companion pair of divider panels as a hinge, the body blank comprising a substantially rectangular piece of corrugated material having a central bottom panel with integral opposite endwall panels, the bottom wall panel having an opposite side pair of wall flaps and each of the endwall panels having an opposite pair of marginal corner flaps.

6. A companion pair of blanks as in claim 5 in which the E divider blank is formed with a companion pair of corner post flanges foldably joined to the endwall panels, that are severed from one another along the longitudinal center line of the blank, each of said corner post flanges having an indented notch area, one of the pair of opposite sidewall flanges of the bottom panel comprising a marginal window flange, opposite ends of the window flange and the notches of the corner post flanges being adopted to register with one another upon erection the E blank and body blank into a container.

7. A container comprising an erected E divide and an erected body wrap, said E divider having an adhesively secured together pair of divider panels, an opposite pair of sidewall panels, and an opposite pair of endwall panels, said body wrap having a pair of endwall panels adhesively secured and laminated to the endwall panels of the erected E divider.

8. A container as in claim 7 in which the body wrap is formed at one side of its bottom panel with a window flange that is adhesively secured to an edge of the erected divider panels.

9. A container as in claim 7 in which the erected E divider includes a pair of corner post flanges constituting terminal ends of the pair of endwall panels, each of the corner flanges being notched to receive corresponding opposite ends of a sidewall flange of the bottom panel of the body wrap.

* * * * *